US005552869A

United States Patent [19]

Schilli et al.

[11] Patent Number: 5,552,869

[45] Date of Patent: Sep. 3, 1996

[54] DRYING METHOD AND APPARATUS FOR ELECTROPHOTOGRAPHY USING LIQUID TONERS

[75] Inventors: Kay F. Schilli, St. Paul; Russell A. Roiko, Rogers; Kent E. Emerson, South St. Paul; Edward J. Woo, Woodbury; Claire A. Jalbert, Cottage Grove, all of Minn.

[73] Assignee: Minnesota Mining and Manufacturing Company, St. Paul, Minn.

[21] Appl. No.: 536,080

[22] Filed: Sep. 29, 1995

[51] Int. Cl.[6] ..... G03G 15/10

[52] U.S. Cl. ..... 355/256; 118/652

[58] Field of Search ..... 355/256; 118/652

[56] References Cited

U.S. PATENT DOCUMENTS

| | | | |
|---|---|---|---|
| 3,809,854 | 5/1974 | Sanders . | |
| 3,857,189 | 12/1974 | Katayama et al. . | |
| 3,899,792 | 8/1975 | Ravera et al. . | |
| 4,258,115 | 3/1981 | Magome et al. . | |
| 4,263,391 | 4/1981 | Saito et al. . | |
| 4,264,191 | 4/1981 | Gerbasi et al. | 355/299 |
| 4,286,039 | 8/1981 | Landa et al. . | |
| 4,299,902 | 11/1981 | Soma et al. . | |
| 4,392,742 | 7/1983 | Landa . | |
| 4,985,733 | 1/1991 | Kurotori et al. . | |
| 5,136,334 | 8/1992 | Camis et al. . | |
| 5,352,558 | 10/1994 | Simms et al. . | |
| 5,420,675 | 5/1995 | Thompson et al. | 355/256 |

*Primary Examiner*—Joan H. Pendegrass
*Assistant Examiner*—Quana Grainger
*Attorney, Agent, or Firm*—Gary L. Griswold; Walter N. Kirn; Susan Moeller Zerull

[57] ABSTRACT

The invention is an apparatus for continuously removing excess carrier liquid from a photoreceptor comprising an image drying means which contacts the photoreceptor, wherein the image drying means has an outer layer which absorbs and desorbs carrier liquid and an inner layer having a Shore A hardness of 10 to 60 which is phobic to the carrier liquid, and a heating means which heats the surface of the image drying means for at least 0.05 seconds to no more than 5° C. below the flashpoint of the carrier liquid, wherein the photoreceptor is moving at a speed of greater than 45 mm/sec. The invention is also the method of removing excess carrier liquid from a photoreceptor comprising contacting the photoreceptor with such a drying element and then heating the drying element to no more than 5° C. below the flashpoint of the carrier liquid for at least 0.05 seconds.

21 Claims, 1 Drawing Sheet

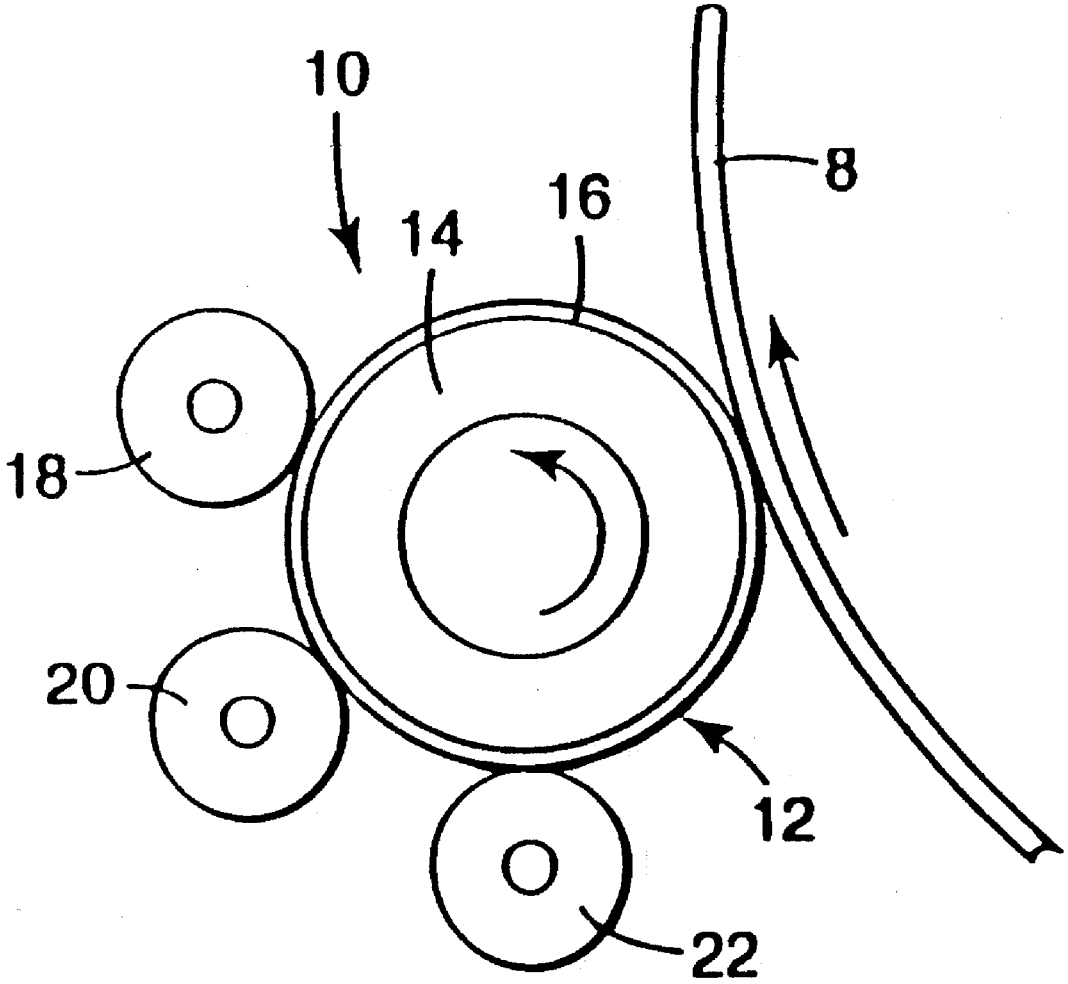
10
14
16
8
18
20
12
22

DRYING METHOD AND APPARATUS FOR ELECTROPHOTOGRAPHY USING LIQUID TONERS

FIELD OF THE INVENTION

This invention relates to electrophotography, especially a drying method and apparatus for use with liquid toners.

BACKGROUND OF THE INVENTION

Electrophotography forms the technical basis for various well known imaging processes, including photocopying and some forms of laser printing. The basic electrophotographic process involves placing a uniform electrostatic charge on a photoconductor element, imagewise exposing the photoconductor element to activating electromagnetic radiation, also referred to herein as "light", thereby dissipating the charge in the exposed areas, developing the resulting electrostatic latent image with a toner, and transferring the toner image from the photoconductor element to a final substrate, such as paper, either by direct transfer or via an intermediate transfer material. The transfer typically occurs by one of two methods: electrostatic assist or elastomeric assist (adhesive transfer). The effectiveness of the latter transfer method is controlled by several variables including surface energy, temperature, and pressure.

The structure of a photoconductor element may be a continuous belt, which is supported and circulated by rollers, or a rotatable drum. All photoconductor elements have a photoconductive layer which transports charge when it is exposed to activating electromagnetic radiation. The photoconductive layer is generally affixed to an electroconductive support. The surface of the photoconductor is either negatively or positively charged such that when activating electromagnetic radiation strikes the photoconductive layer, charge is conducted through the photoconductor in that region to neutralize or reduce the surface potential in the illuminated region. An optional barrier layer may be used over the photoconductive layer to protect the photoconductive layer and extend the service life of the photoconductive layer. Other layers, such as adhesive or priming layers or charge injection blocking layers, are also used in some photoconductor elements. A release layer may be used to facilitate transfer of the image from the photoconductor element, also referred to herein as the photoreceptor, to either the final substrate, such as paper, or to an intermediate transfer element.

Typically, a positively charged toner is attracted to those areas of the photoconductor element which retain a negative charge after the imagewise exposure, thereby forming a toner image which corresponds to the electrostatic latent image. The toner need not be positively charged. Some toners are attracted to the areas of the photoconductor element where the charge has been dissipated. The toner may be either a powdered material comprising a blend of polymer and colored particulates, typically carbon, or a liquid material of finely divided solids dispersed in an insulating liquid frequently referred to as a carrier liquid.

Typically, the carrier liquid is a hydrocarbon that has a low dielectric constant (e.g., less than 3) and a vapor pressure sufficiently high to ensure rapid evaporation of solvent following deposition of the toner onto a photoreceptor, transfer belt, and/or receptor sheet. Rapid evaporation is particularly important for cases in which multiple colors are sequentially deposited and/or transferred to form a single image. Examples of such carrier liquids include NORPAR™ and ISOPAR™ solvents from Exxon Chemical Company.

Liquid toners are often preferable because they are capable of giving higher resolution images and require lower energy for image fixing than do dry toners. However, excess carrier liquid which is transferred to the photoconductor element can create a variety of problems. When elastomeric or adhesive transfer mechanism is being used, removal of excess carrier liquid is especially important. The excess carrier liquid can blot or stain the image or can cause smudging or streaking of the images. In addition, if excess carrier liquid is not removed, additional energy will be required at the image fixing step. Also, removal of the excess carrier liquid generally leads to improved image clarity and image density.

A variety of methods have been employed to remove excess carrier liquid from a developed toner image. These methods include squeegee rolls, air knives, corona discharge, vacuum removal, and absorption.

U.S. Pat. No. 5,420,675 discloses the use of a film forming roll which has a thin, outer layer which is phillic with the carrier liquid and an inner layer which is carrier liquid-phobic and compressible. The film forming roll of that patent is maintained in contact with a single heating roll. The carrier liquid entrained in the film forming roll is removed by heating the liquid to a temperature greater than or equal to the flashpoint of the liquid.

SUMMARY OF THE INVENTION

As the speed of imaging and developing increases, a need has arisen for corresponding increase in drying capacity and speed. The present invention is an improved system for removing excess carrier liquid from an image produced by liquid electrophotography. This improved drying system can continuously remove carrier liquid from a photoreceptor which is moving at a rate greater than 45 mm/sec, which corresponds to about 10 pages of standard 8.5"×11" paper per minute in portrait mode. Preferably, the process speed is from 10 to 20 pages per minute (45–90 mm/sec), more preferably 12 to 17 pages per minute (54–78 mm/sec).

According to a first embodiment, the present invention is an apparatus for continuously removing excess carrier liquid from a photoreceptor comprising an image drying means which contacts the photoreceptor, wherein the image drying means has an outer layer which absorbs and desorbs carrier liquid and an inner layer having a Shore A hardness of 10 to 60 which is phobic to the carrier liquid, and a heating means which heals the surface of the image drying means for at least 0.05 seconds, preferably 0.1 seconds, most preferably at least 0.2 seconds, to no more than 5° C. below the flashpoint of the carrier liquid, wherein the photoreceptor is moving at a speed of greater than 45 mm/sec.

According to a second embodiment, the present invention is a method for removing excess carrier liquid from a photoconductor comprising contacting the photoconductor with an image drying element which comprises an outer layer which absorbs carrier liquid and an inner layer having a Shore A hardness of 10 to 60 which is phobic to the carrier liquid, and heating the image drying element for at least 0.05 seconds to no more than 5° C. below the flashpoint of the carrier liquid, wherein the photoreceptor is moving at a speed of at least 45 mm/second.

"Continuously" means that the system reaches steady state at which the amount of carrier liquid picked up by the drying roll from the photoconductor equals the amount of carrier liquid removed from the drying roll during the heating step.

Preferably, the system further comprises a cooling means which cools the image drying roll after the heating means.

BRIEF DESCRIPTION OF THE DRAWING

The FIGURE shows a preferred embodiment of the drying system of this invention.

DETAILED DESCRIPTION OF THE INVENTION

Referring to the FIGURE, the image drying means 12 for the drying system 10 contacts the photoreceptor 8 which has been imaged and developed with liquid toner. The drying means may be a roll, as shown in the FIGURE, a belt, or other similar structures. During the contact of the photoreceptor and the drying roll, excess carrier liquid is absorbed by the oleophilic outer layer 16 of the drying roll. The drying roll is then heated by the heating means 18 and 20. The heating means must provide sufficient heat to raise the surface temperature of the drying roll to a temperature in the range of the $T_{fpcl}$ (flash point of the carrier liquid) minus 20° C. to $T_{fpcl}$ minus 5° C. For preferred carrier liquids, such as NORPAR™ 12, the surface of the drying roll is raised to between about 45° to 55° C.

The heating means preferably are at least two hot rolls as shown in the FIGURE. Locating the heating rolls close to the photoreceptor may provide some advantage in that more carrier liquid will begin to diffuse from the drying roll more quickly. However, the rolls must not be so close to the photoreceptor that the heat from the rolls damages the photoreceptor. When two heating rolls are used, the surface of the heating rolls preferably are heated to less than the flash point of the carrier liquid, preferably 45° to 60° C. Higher temperatures may be used but can create problems such as transfer of the toner to the drying roll and shortened lifetime of the drying roll. In addition, for safety reasons it is desirable to remain below the flashpoint of the carrier liquid. Other heating means such as heat lamp, a heating belt, hot air, and similar means may be used. However, a single heating roll has been found by the inventors to be unsuitable because the limited surface contact between a single heating roll and the drying roll does not provide sufficient heat to remove the carrier liquid at high imaging speeds (10 pages per minute or 45 mm/sec). Increasing the temperature of the single heating roll creates problems such as transfer of the toner to the drying roll, increased energy consumption, damage to the photoreceptor, shortened lifetime of the drying roll, etc.

The heating rolls may be two aluminum rolls with internal heating lamps. The contact area between the image drying roll and the heating rolls has been found by the Inventors to be one key to the effectiveness of the drying. Preferably, the contact area for each roll is greater than 2 mm, more preferably 3–5 mm. This corresponds to a minimum heating time for two rolls of about 0.05 seconds.

The Inventors have found that carrier liquid vapors removed from the drying roll may condense in the cooler air around the photoreceptor. These vapors may decrease the drying efficiency. In addition, if the drying roll becomes too hot and the toners on the photoreceptor approach a glass transition temperature or a melting temperature, the toner image may adhere to the drying roll. Therefore, preferably, alter contact with the heating means, the drying roll is contacted with a cooling means 22. Locating the cooling means close to the photoreceptor may be desirable in that the drying roll will stay hot longer thereby increasing the diffusion rate of the carrier liquid out of the drying roll. The cooling means is preferably a chilling roll 22, which is held in contact with the image drying roll. Under certain conditions, it may be desirable to control the temperature of the chilling roll by passing air or a heat transfer fluid through the chilling roll.

The image drying roll comprises a core with two polymer layers on the surface. The core may be any material which is rigid at the operating temperatures. Aluminum is a preferred core material.

The inner polymer layer is selected from materials which are oleophobic, i.e., they do not absorb the carrier liquid. The inner polymer layer needs to be compressible or compliant in order to increase contact time with the heating rolls. Preferably, the inner polymer layer has a Shore A hardness in the range from 10 to 60, more preferably in the range of 20 to 50. Suitable materials useful for the oleophobic core include urethanes, nitriles, fluorocarbons, fluorosilicones. Urethanes are especially advantageous because they adhere well to the preferred outer polymer layer. The inner polymer layer may be molded onto the roll. The thickness of the inner layer is preferably in the range of 2–8 mm.

The outer polymer layer is selected from materials which are oleophilic, i.e., they absorb the carrier liquid. Since the outer layer contacts the photoreceptor, the drying roll must not disturb the toner deposited on the photoreceptor. Preferably, the outer layer is smooth especially as compared to foam and other similar drying rolls. To prevent the drying roll from disturbing the toner, the outer layer of the drying roll must have a lower surface energy than the toner. If the outer layer has a higher surface energy than the toner, the toner would preferentially transfer to the drying roll. In addition, toner will transfer to the drying roll if free energy can be reduced, i.e. if there is more interfacial tension between the photoconductor and the toner than between the toner and the drying roll. Therefore, the outer layer of the drying roll preferably also has a surface energy lower than that of the surface of the photoreceptor. The surface energy is preferably at least 1 dyne/cm less than the lower of the surface energy of the toner and the surface energy of the photoreceptor. Preferably, therefore, the outer layer has a surface energy less than 30 dyne/cm, more preferably less than 27 dyne/cm.

The outer layer preferably has the capacity to absorb about 500 mg of carrier liquid. Preferably, the outer layer material can absorb carrier liquid in amounts greater than 70%, more preferably greater than 100%, of the weight of the dry outer layer material (i.e. weight carrier liquid absorbed divided by weight of dry outer layer is greater than 0.7, more preferably greater than 1). This absorbency may be measured by immersing the material in carrier liquid and waiting until the material stops absorbing carrier liquid as indicated by no further weight gain of the sample.

While the outer layer must be absorbent, the carrier liquid must also be removed from the drying roll to prevent saturation. The rate of desorption is dependent on the diffusion coefficient of the carrier liquid in the outer layer material, the thickness of the outer layer, the concentration, and the temperature. Preferably, the diffusion coefficient is at least $0.5\times10^{-6}$ $cm^2/s$ at a temperature of 60° C.

Suitable materials include silicones, ethylene/propylene copolymers, polybutadienes, and polyisoprenes. Silicones are especially preferred. The inventors have found that fillers can be advantageously used in the drying material. Inclusion of fillers tends to increase the surface energy but also increases the diffusion coefficient. Some suitable fillers include silica, iron oxide, calcium carbonate, titanium dioxide, carbon black, etc. Preferably, the amount of fillers is less than 30%, more preferably greater than 0 to less than 10%, based on total weight of the outer layer.

The thickness of the outer layer is preferably less than 125 μm, more preferably 35 to 75 μm. The outer layer may be applied by any means suitable for applying a layer of less than 125 μm, such as spray coating or knife coating.

EXAMPLES

Comparative Example 1

A drying roll was made having a nitrile rubber underlayer with a Shore A hardness of 50 and an oleophilic silicone outer layer, E2 (from Ames Rubber Corp.). The oleophilic outer layer had a thickness of 50 μm. The inner layer was 2.54 mm thick. A system having a single heater roll was compared to a system having two heater rolls. The temperature of the outer surface of the heater rolls was maintained at 90° C. The drying roll was contacted with a photoreceptor bearing NORPAR™ 12. The process was run at 40 mm/sec. Even at these relatively high temperatures, the single roll system failed to continue removing sufficient amounts of excess carrier liquid after 70 cycles. In contrast, the dual roll system reached steady state and continued to remove excess carrier liquid after hundreds of cycles.

Comparative Example 2

A drying roll was prepared as indicated above. The thickness of the nitrile underlayer was 2 mm. The thickness of the silicone top coat was 0.127 mm. The contact area between a single heater roll and the drying roll was 2.5 mm. Temperature of the heater roll was 92° C. At a rate of 24.5 mm/sec failure occurred after 7 minutes and 12 seconds.

When the contact area was increased to 3.8 mm at the same high temperature, the drying roll worked for 18 minutes without failure at which time the test was stopped.

The speed was increased to 52.4 mm/sec. Failure occurred in only 2 minutes.

EXAMPLE 3

A drying roll was prepared as in Example 2 except that a urethane inner layer (Shore A hardness of 20) was used in place of the nitrile inner layer. A single heater roll was maintained at 60° C. No failure occurred during an 8 minute test at 40 mm/sec. However, when the rate was increased to 52 mm/sec, the system failed after one minute and 20 seconds. When a second roll was added, the system lasted for 5 minutes and 43 seconds. No optimization was done with regard to contact area.

EXAMPLE 4

Various drying rolls were prepared using various materials as shown in the table below:

| Sample | Topcoat | Absorption Norpar 12 (%) | Surface Energy (dyne/cm) | Diffusion coefficient ($cm^2/s$) | Underlayer (Shore A hardness) |
|---|---|---|---|---|---|
| A | fluorosilicone | 0.3 | 27 | — | polyurethane (50) |
| B | E2* | 80 | 25 | $0.4 \times 10^{-6}$ | silicone (50) |
| C | E2 | 80 | 25 | $0.4 \times 10^{-6}$ | nitrile (50) |
| D | ** | 160 | 24 | $0.8 \times 10^{-6}$ | polyurethane (50) |
| E | LIM6*** | 80 | 25 | $70 \times 10^{-6}$ | polyurethane (50) |
| F | ** | 160 | 24 | $0.8 \times 10^{-6}$ | polyurethane (20) |

*From Ames Rubber Corp.
**1 part DC 186 resin mixed with 5 parts DC186 curative (both from Dow Corning) and 1 part SE33 (GE Silicones). Includes about 8% by weight silica filler.
***From Rogers Corp. includes an iron oxide filler.

The thickness of the top coat was 50 μm. The thickness of the underlayer was 2.54 mm.

Prints were made using black toner as described in Example 40 of copending application bearing attorney docket no. 52069USA8A, filed on the same day as this application. The images were created on a photoreceptor having an inverted dual layer photoconductive layer as described in copending U.S. patent application 08/431,022, Example 6. The photoconductive layer had an interlayer coated on it. The interlayer contained 325.4 g of 6% S-lec Bx-5 (from Sekisusi Chemical Co.in MeOH), 1395 g IPA, 50 g Nalco 1057 colloidal silica, 49.5 g 5% Z-6040 silane (Dow Corning 50/50 in IPA/$H_2O$), 194.6 g 1.5% Gantrex AN-169 Polymer (ISP Technologies 50/50 in MeOH/$H_2O$). A release layer was coated over the interlayer. The release layer was made from 5 parts 15% Syloff™23, 0.56 parts PS342.5, 0.19 parts NM203, 40.96 parts heptane, 0.16 parts 1% PT catalyst. The heaters for the two heating rolls were set to 50° C. The pressure between the drying roll and the photoreceptor was 65 psi. The results for each drying roll are shown below.

| Sample | # of Prints Before Failure |
|---|---|
| A | 0 |
| B | 10 |
| C | 15 |
| D | >50 |
| E | >25 (delamination between the inner and outerlayer occurred) |
| F | >50 |

The above samples show that if the absorption level is too low or the diffusion coefficient is too low the drying roll will not be effective. The inclusion of fillers in the topcoat as in Samples D, E, and F improves the diffusion coefficient and thus, improves the operation of the drying system.

What is claimed is:

1. An apparatus for removing excess carrier liquid from a photoreceptor comprising an image drying element which contacts the photoreceptor, wherein the image drying element has an outer layer which absorbs carrier liquid and an inner layer having a Shore A hardness of 10 to 60 which is phobic to the carrier liquid, a heating means which heats the surface of the image drying element for at least 0.05 seconds to no more than 5° C. below the flashpoint of the carrier liquid, wherein the photoreceptor is moving at a speed of at least 45 mm/second.

2. The apparatus of claim 1 further comprising a cooling means which cools the image drying element after the heating means.

3. The apparatus of claim 1 in which the heating means comprises at least two hot rollers.

4. The apparatus of claim 2 in which the cooling means comprises a cooling roller.

5. The apparatus of claim 1 in which the drying element is a drying roll.

6. The apparatus of claim 1 in which the outer layer has a surface energy less than 30 dyne/cm.

7. The apparatus of claim 1 in which the outer layer has a thickness less than 125 μm.

8. The apparatus of claim 1 in which the outer layer has a diffusion coefficient for diffusion of the carrier liquid through the outer layer of no less than $0.5\times10^{-6}$ $cm^2/s$ at 60° C.

9. The apparatus of claim 1 in which the outer layer comprises a polymer selected from silicones, ethylene/propylene copolymers, polybutadienes, and polyisoprenes.

10. The apparatus of claim 1 in which the inner layer comprises a polymer selected from nitriles, fluorosilicones, fluorocarbons, and polyurethanes.

11. The apparatus of claim 1 in which the outer layer further comprises a filler in an amount less than 30% based on total weight of the outer layer.

12. The apparatus of claim 8 in which the filler is silica.

13. The apparatus of claim 1 wherein the outer layer of the drying roll has a surface energy and the photoreceptor has a surface energy and the surface energy of the outer layer is at least 1 dyne/cm less than the surface energy of the photoreceptor.

14. The apparatus of claim 1 wherein there is toner, which has a surface energy, distributed on the surface of the photoreceptor, and the outer layer of the drying roll has a surface energy that is at least 1 dyne/cm less than the surface energy of the toner.

15. The apparatus of claim 14 wherein the photoreceptor has a surface energy which is at least 1 dyne/cm more than the surface energy of the outer layer of the drying roll.

16. The apparatus of claim 1 wherein the outer layer can absorb carrier liquid in amounts greater than 70% of the weight of the dry outer layer material.

17. A method for removing excess carrier liquid from a photoconductor comprising contacting the photoconductor with an image drying element which comprises an outer layer which absorbs carrier liquid and an inner layer having a Shore A hardness of 10 to 60 which is phobic to the carrier liquid, and after the contacting step, heating the image drying element for at least 0.05 seconds to no more than 5° C. below the flashpoint of the carrier liquid, wherein the photoreceptor is moving at an average speed of at least 45 mm/second.

18. The method of claim 17 further comprising the step of cooling the image drying element after the heating step.

19. The method of claim 17 wherein the outer layer can absorb carrier liquid in amounts greater than 70% of the weight of the dry outer layer material.

20. The method of claim 17 wherein the outer layer of the drying roll has a surface energy and the photoreceptor has a surface energy and the surface energy of the outer layer is at least 1 dyne/cm less than the surface energy of the photoreceptor.

21. The method of claim 17 in which the outer layer has a diffusion coefficient for diffusion of the carrier liquid through the outer layer of no less than $0.5\times10^{-6}$ $cm^2/s$ at 60° C.

* * * * *